US012631377B2

(12) United States Patent
Kim et al.

(10) Patent No.: US 12,631,377 B2
(45) Date of Patent: May 19, 2026

(54) INTEGRATED THERMAL MANAGEMENT SYSTEM FOR MOBILITY

(71) Applicant: HYUNDAI WIA Corporation, Changwon-si (KR)

(72) Inventors: Hyung Seob Kim, Anyang-si (KR); Man Hee Kim, Seoul (KR); Youn Han Kim, Yongin-si (KR); Jun Ho Kim, Anyang-si (KR); Se Min Lee, Uiwang-si (KR); Bong Jun Park, Uiwang-si (KR)

(73) Assignee: Hyundai Wia Corporation, Changwon-si (KR)

( * ) Notice: Subject to any disclaimer, the term of this patent is extended or adjusted under 35 U.S.C. 154(b) by 287 days.

(21) Appl. No.: 18/307,689

(22) Filed: Apr. 26, 2023

(65) Prior Publication Data

US 2023/0349605 A1 Nov. 2, 2023

(30) Foreign Application Priority Data

Apr. 28, 2022 (KR) ..... 10-2022-0053005

(51) Int. Cl.
*F25B 41/20* (2021.01)
*F25B 13/00* (2006.01)

(52) U.S. Cl.
CPC ..... *F25B 41/20* (2021.01); *F25B 13/00* (2013.01)

(58) Field of Classification Search
CPC ..... B60H 2001/00928; B60H 1/00921; B60H 1/3204; B60H 1/00321; B60H 1/00735; B60H 1/3205; B60H 1/3227; B60H 1/3228; B60H 1/3229; B60H 1/323; B60H 2001/3286; B60H 1/00278; B60H 1/00885; B60H 1/00899; B60H 1/143; B60H 1/2225; F25B 41/20; F25B 13/00; F25B 25/005; F25B 2600/2507; F25B 41/30; F25B 5/02; F25B 2600/02; F25B 5/04; F25B 2600/2513; F25B 2600/2515; F25B 41/42
See application file for complete search history.

(56) References Cited

FOREIGN PATENT DOCUMENTS

| | | | | |
|---|---|---|---|---|
| CN | 106061777 | A | 10/2016 | |
| CN | 114144321 | A | 3/2022 | |
| DE | 112018002070 | T5 * | 12/2019 | ..... B60H 1/00921 |
| DE | 112018003766 | T5 * | 4/2020 | ..... F25B 6/04 |
| JP | 2020-114694 | A | 7/2020 | |
| JP | 2021-020486 | A | 2/2021 | |
| KR | 10-2014-0147365 | A | 12/2014 | |
| KR | 10-2019-0047198 | A | 5/2019 | |

(Continued)

OTHER PUBLICATIONS

Office Action in corresponding CN Application No. 202310466139.4 dated Feb. 27, 2026.

*Primary Examiner* — Kun Kai Ma
(74) *Attorney, Agent, or Firm* — Knobbe, Martens, Olson & Bear, LLP

(57) ABSTRACT

An integrated thermal management system for a mobility is proposed. The integrated thermal management system is configured to secure the efficiency of various thermal management modes including heating, cooling, dehumidifying, and cooling of parts, and to be reduced in manufacturing cost and package size by reducing valves and pipes provided to implement the thermal management modes.

10 Claims, 11 Drawing Sheets

(56) References Cited

FOREIGN PATENT DOCUMENTS

| | | | | | |
|---|---|---|---|---|---|
| KR | 10-2020-0017923 | A | | 2/2020 | |
| WO | WO-2019001330 | A1 | * | 1/2019 | ..... H01M 10/663 |
| WO | WO-2019031221 | A1 | * | 2/2019 | ..... F25B 43/00 |
| WO | WO-2020149063 | A1 | * | 7/2020 | ..... F25B 47/02 |
| WO | WO-2021015270 | A1 | * | 1/2021 | ..... F25B 41/20 |

* cited by examiner

INTEGRATED THERMAL MANAGEMENT SYSTEM FOR MOBILITY

CROSS REFERENCE TO RELATED APPLICATION

The present application claims priority to Korean Patent Application No. 10-2022-0053005, filed Apr. 28, 2022, the entire contents of which is incorporated herein for all purposes by this reference.

BACKGROUND

Field

The present disclosure relates generally to an integrated thermal management system for a mobility. More particularly, the present disclosure relates to an integrated thermal management system for a mobility, and the system is configured to secure the efficiency of various thermal management modes including heating, cooling, dehumidifying, and cooling of parts, and to be reduced in manufacturing cost and package size by reducing valves and pipes provided to implement the thermal management modes.

Description of the Related Art

Recently, due to environmental issues of internal combustion engine vehicles, electric vehicles, etc., are being widely used as eco-friendly vehicles. However, in the case of an existing internal combustion engine vehicle, indoor heating using waste heat of an engine thereof can be performed, so there is no need for separate energy for indoor heating, but in the case of an electric vehicle and the like, since there is no engine and no heat source, indoor heating must be performed using separate energy, so fuel efficiency of the electric vehicle is reduced. The driving range of the electric vehicle is shortened and inconvenience, such as the need for frequent charging is caused.

The foregoing is intended merely to aid in the understanding of the background of the present disclosure, and is not intended to mean that the present disclosure falls within the purview of the related art that is already known to those skilled in the art.

SUMMARY

Embodiments of the present disclosure provide an integrated thermal management system for a mobility, and the system is configured to secure the efficiency of various thermal management modes including heating, cooling, dehumidifying, and cooling of parts, and to be reduced in manufacturing cost and package size by reducing valves and pipes provided to implement the thermal management modes.

According to embodiments of the present disclosure, an integrated thermal management system for a mobility includes: a first refrigerant line through which a refrigerant may be circulated, including a compressor, an indoor condenser, an expansion valve, an outdoor condenser, and an evaporator, and including a first flow control valve arranged between the outdoor condenser and the evaporator and configured to selectively expand a distribution direction of the refrigerant and the refrigerant; and a second refrigerant line including a heat exchanger provided at a front end of the compressor and configured to perform heat exchange with another cooling medium, and branching from both of a front end and a rear end of the outdoor condenser to merge together and then connected to a front end of the heat exchanger, and including a second flow control valve arranged on a merging point of the branching lines and configured to selectively expand the distribution direction of the refrigerant and the refrigerant.

On the first refrigerant line, the expansion valve may be arranged in rear of a front branching point of the outdoor condenser in the second refrigerant line.

The first flow control valve may include a first port toward the outdoor condenser, a second port toward the compressor, and a third port toward the evaporator, wherein the third port may include a first expander so that the refrigerant may selectively expand.

The second flow control valve may include a fourth port toward a front end of the outdoor condenser, a fifth port toward a rear end of the outdoor condenser, and a sixth port toward the heat exchanger, wherein the sixth port may include a second expander so that the refrigerant may selectively expand.

The integrated thermal management system may include: a controller configured to control the compressor, the expansion valve, the first flow control valve, and the second flow control valve in response to a thermal management mode.

When cooling a cooling medium through the heat exchanger, the controller may control the expansion valve to be opened, and in the first flow control valve, the controller may control the second port to be closed and the first expander to perform closing operation, and in the second flow control valve, the controller may control the fifth port and the sixth port to be opened and the second expander to perform an expanding operation.

When cooling an indoor space, the controller may control the expansion valve to be opened, and in the first flow control valve, the controller may control the first port and the third port to be opened and the first expander to perform an expanding operation, and in the second flow control valve, the controller may control the fourth port to be closed and the second expander to perform a closing operation.

When heating an indoor space, the controller may control the expansion valve to perform an expanding operation, in the first flow control valve, the controller may control the first port and the second port to be opened and the first expander to perform closing operation, and in the second flow control valve, the controller may control the fourth port and the sixth port to be opened and the second expander to perform an expanding operation.

When heating an indoor space, the controller may control the expansion valve to perform an expanding operation, in the first flow control valve, the controller may control the first port and the second port to be opened and the first expander to perform closing operation, and in the second flow control valve, the controller may control the fourth port to be closed and the second expander to perform closing operation.

When heating an indoor space, the controller may control the expansion valve to perform closing operation, in the second flow control valve, the controller may control the fourth port and the sixth port to be opened and the second expander to perform an expanding operation.

When heating and dehumidifying an indoor space, the controller may control the expansion valve to perform an expanding operation, in the first flow control valve, the controller controls the first port and the third port to be opened and the first expander to perform an expanding operation, in the second flow control valve, the controller may control the fourth port to be closed and the second expander to perform closing operation.

An integrated thermal management system may include: a first coolant line configured to distribute a coolant into a first water pump, an electronic part, a heat exchanger, a first radiator, and a reservoir, and including a first coolant valve configured to selectively distribute the coolant into the electronic part, the heat exchanger, and the first radiator; a second coolant line configured to distribute the coolant into a second water pump, a battery, the heat exchanger, a second radiator, and the reservoir, and including a second coolant valve configured to selectively distribute the coolant into the battery, the heat exchanger, and the second radiator; a first refrigerant line configured to distribute a refrigerant a compressor, an indoor condenser, an expansion valve, an outdoor condenser, and an evaporator, and including a first flow control valve arranged between the outdoor condenser and the evaporator and configured to selectively expand a distribution direction of the refrigerant and the refrigerant; and a second refrigerant line respectively branch from a front end and a rear end of the outdoor condenser to merge together and then connected to a front end of the heat exchanger, and including a second flow control valve arranged at a merging point of the branching lines and configured to selectively expand the distribution direction of the refrigerant and the refrigerant.

The first coolant valve may include a first coolant port toward the first radiator, a second coolant port toward the heat exchanger, and a third coolant port toward the electronic part, and the second coolant valve may include a fourth coolant port toward the second radiator, a fifth coolant port toward the heat exchanger, and a sixth coolant port toward the battery.

The first flow control valve may include a first port toward the outdoor condenser, a second port toward the compressor, and a third port toward the evaporator, wherein the third port may include a first expander so that the refrigerant may selectively expand, and the second flow control valve may include a fourth port toward a front end of the outdoor condenser, a fifth port toward a rear end of the outdoor condenser, and a sixth port toward the heat exchanger, wherein the sixth port may include a second expander so that the refrigerant may selectively expand.

An integrated thermal management system for a mobility may include: a first coolant line configured to distribute a coolant into a first water pump, an electronic part, a first heat exchanger, a first radiator, and a first reservoir, and including a first coolant valve between the first heat exchanger and the first radiator; a second coolant line configured to distribute the coolant into a second water pump, a battery, a first reservoir, and the first reservoir; a third coolant line configured to distribute the coolant into a third water pump, a second radiator, and a second reservoir, and connected to the second coolant line by a second coolant valve as a medium; a first refrigerant line configured to distribute a refrigerant into a compressor, an indoor condenser, an expansion valve, the first heat exchanger, an outdoor condenser, and an evaporator, and including a first flow control valve arranged between the outdoor condenser and the evaporator and configured to selectively expand a distribution direction of the refrigerant and the refrigerant; and a second refrigerant line branching from both of a front end of the first heat exchanger and a rear end of the outdoor condenser to merge together and then connected to a front end of the first reservoir, and including a second flow control valve arranged at a merging point of the branching lines and configured to selectively expand the distribution direction of the refrigerant and the refrigerant.

The first coolant valve may include a first coolant port toward a front end of the first radiator, a second coolant port toward a rear end of the first radiator, and a third coolant port toward the first heat exchanger, and the second coolant valve may include a fourth coolant port toward a front end of the battery, a fifth coolant port toward a rear end of the battery, and a sixth coolant port toward the second radiator.

The first flow control valve may include a first port toward the outdoor condenser, a second port toward the compressor, and a third port toward the evaporator, wherein the third port may include a first expander so that the refrigerant may selectively expand, and the second flow control valve may include a fourth port toward the front end of the first heat exchanger, a fifth port toward the rear end of the outdoor condenser, and a sixth port toward the first reservoir, wherein the sixth port may include a second expander so that the refrigerant may selectively expand.

An integrated thermal management system for a mobility may include: a first coolant line configured to distribute a coolant into a first water pump, an electronic part, a first heat exchanger, a radiator, and a reservoir, and including a first coolant valve between the first heat exchanger and the radiator; a second coolant line configured to distribute the coolant into a second water pump, a battery, and a first reservoir, and connected to the first coolant line by a second coolant valve as a medium; a first refrigerant line configured to distribute a refrigerant into a compressor, an indoor condenser, an expansion valve, the first heat exchanger, an outdoor condenser, and an evaporator, and including a first flow control valve arranged between the outdoor condenser and the evaporator and configured to selectively expand a distribution direction of the refrigerant and the refrigerant; and a second refrigerant line branching from both of a front end of the first heat exchanger and a rear end of the outdoor condenser to merge together and then connected to a front end of the first reservoir, and including a second flow control valve arranged at a merging point of the branching lines and configured to selectively expand the distribution direction of the refrigerant and the refrigerant.

The first coolant valve may include a first coolant port toward a front end of the radiator, a second coolant port toward a rear end of the radiator, and a third coolant port toward the first heat exchanger, and the second coolant valve may include a fourth coolant port toward the battery, a fifth coolant port toward the first reservoir, a sixth coolant port toward the electronic part, and a seventh coolant port toward the rear end of the radiator.

The first flow control valve may include a first port toward the outdoor condenser, a second port toward the compressor, and a third port toward the evaporator, wherein the third port may include a first expander so that the refrigerant may selectively expand, and the second flow control valve may include a fourth port toward the front end of the first heat exchanger, a fifth port toward the rear end of the outdoor condenser, and a sixth port toward the first reservoir, wherein the sixth port may include a second expander so that the refrigerant may selectively expand.

The integrated thermal management system for a mobility, the integrated thermal management system including the above-described structure, can secure the efficiency of various thermal management modes including heating, cooling, dehumidifying, and cooling of parts, and can be reduced in manufacturing cost and package with the reduced valves and pipes provided to implement the thermal management modes.

DETAILED DESCRIPTION OF EMBODIMENTS

Hereinbelow, an integrated thermal management system for a mobility according to embodiments of the present disclosure will be described with reference to accompanying drawings.

Meanwhile, due to the electrification of vehicles, not only the indoor space of a vehicle, but also thermal management needs of electric parts such as a high voltage battery and a motor are added. In other words, in the case of electric vehicles, needs of each air conditioning for the indoor space, battery, and electric part are different, and it may be necessary to have a technique that can save energy as much as possible through independent response to each air conditioning and efficient collaboration between air conditionings. Accordingly, a concept of integrated thermal management of a vehicle is proposed, and the integrated thermal management is intended to increase thermal efficiency by performing thermal management independently for each part and at the same time integrating thermal management of the entire vehicle.

In order to perform the integrated thermal management of a vehicle, it may be necessary to integrate and modularize complex coolant lines and parts, and the concept of modularization is needed not only for modularization of a plurality of parts, but also for simplification of manufacturing and compactification thereof.

Furthermore, in electrified vehicles, during indoor heating or indoor cooling, as electric energy to be consumed needs to be reduced through efficiently energy management, it may be necessary to have a technique for efficient indoor heating and cooling.

Figure 1:
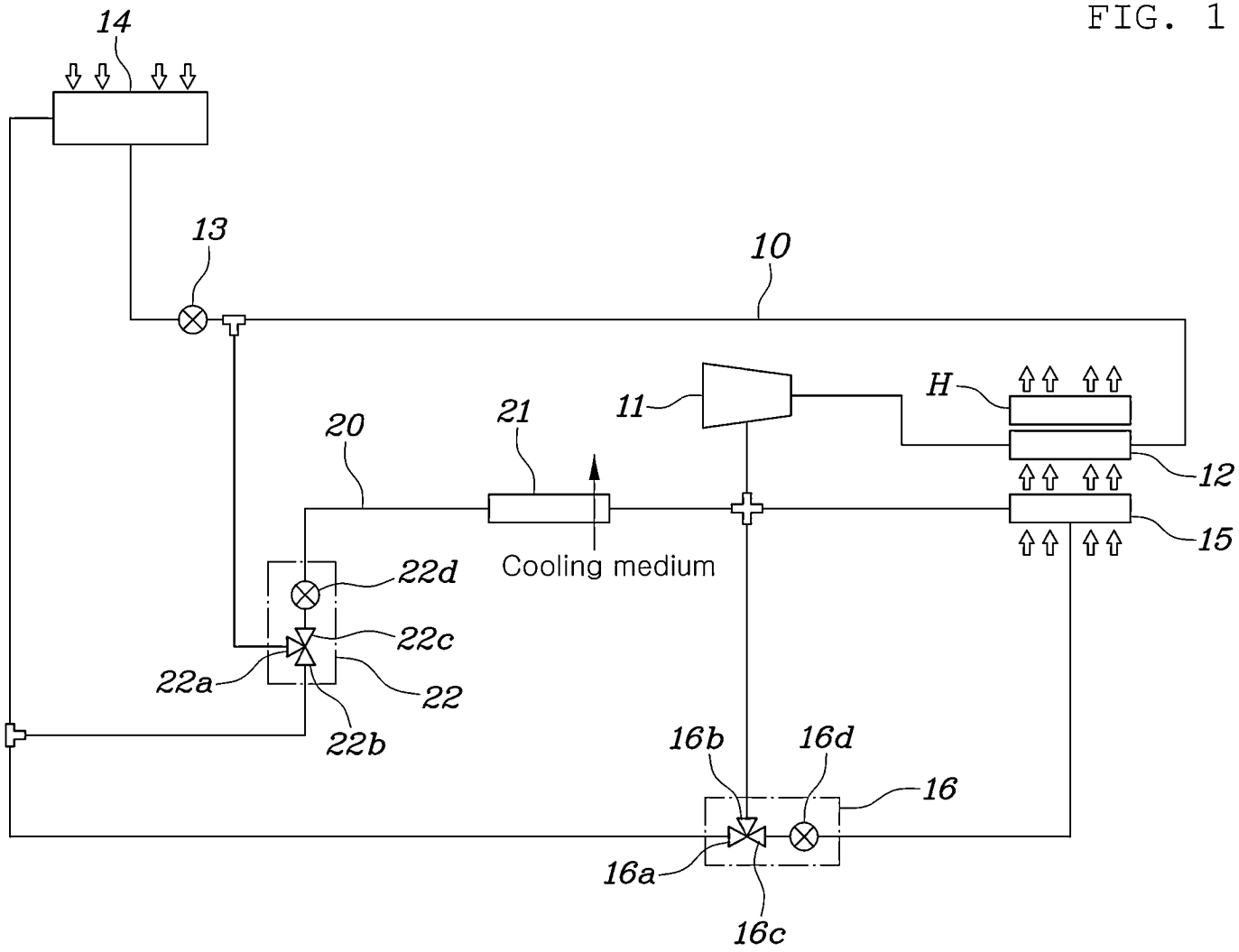
FIG. 1 is a circuit diagram of an integrated thermal management system for a mobility according to embodiments of the present disclosure.
Figure 2:
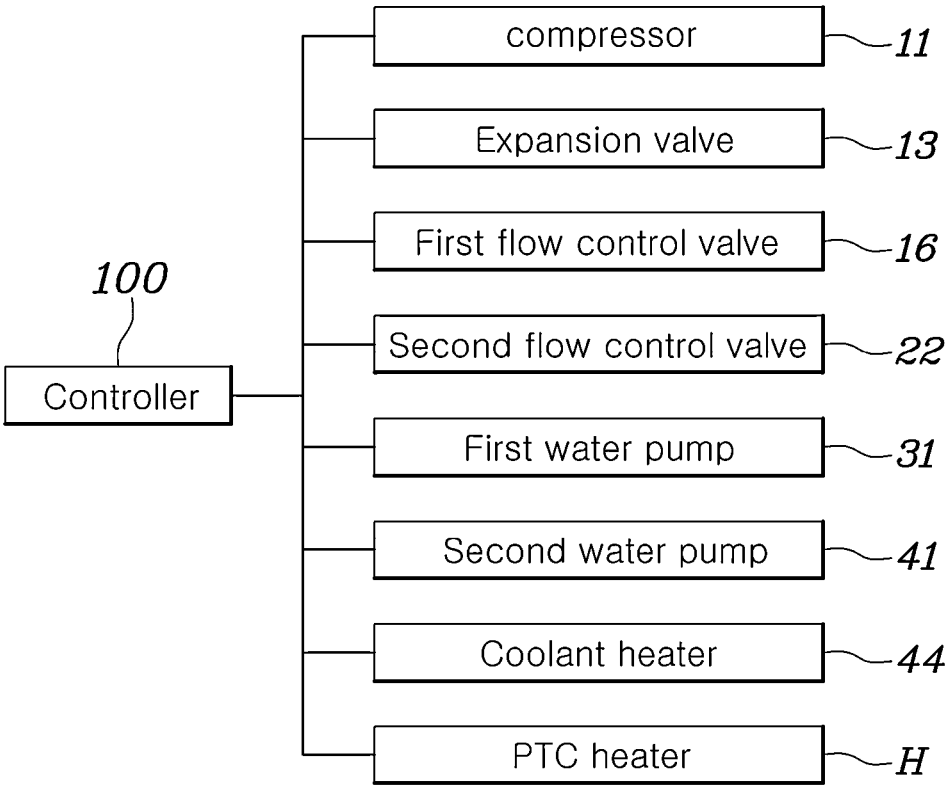
FIG. 2 is a block diagram of the integrated thermal management system for a mobility according to embodiments of the present disclosure.
Figure 3:
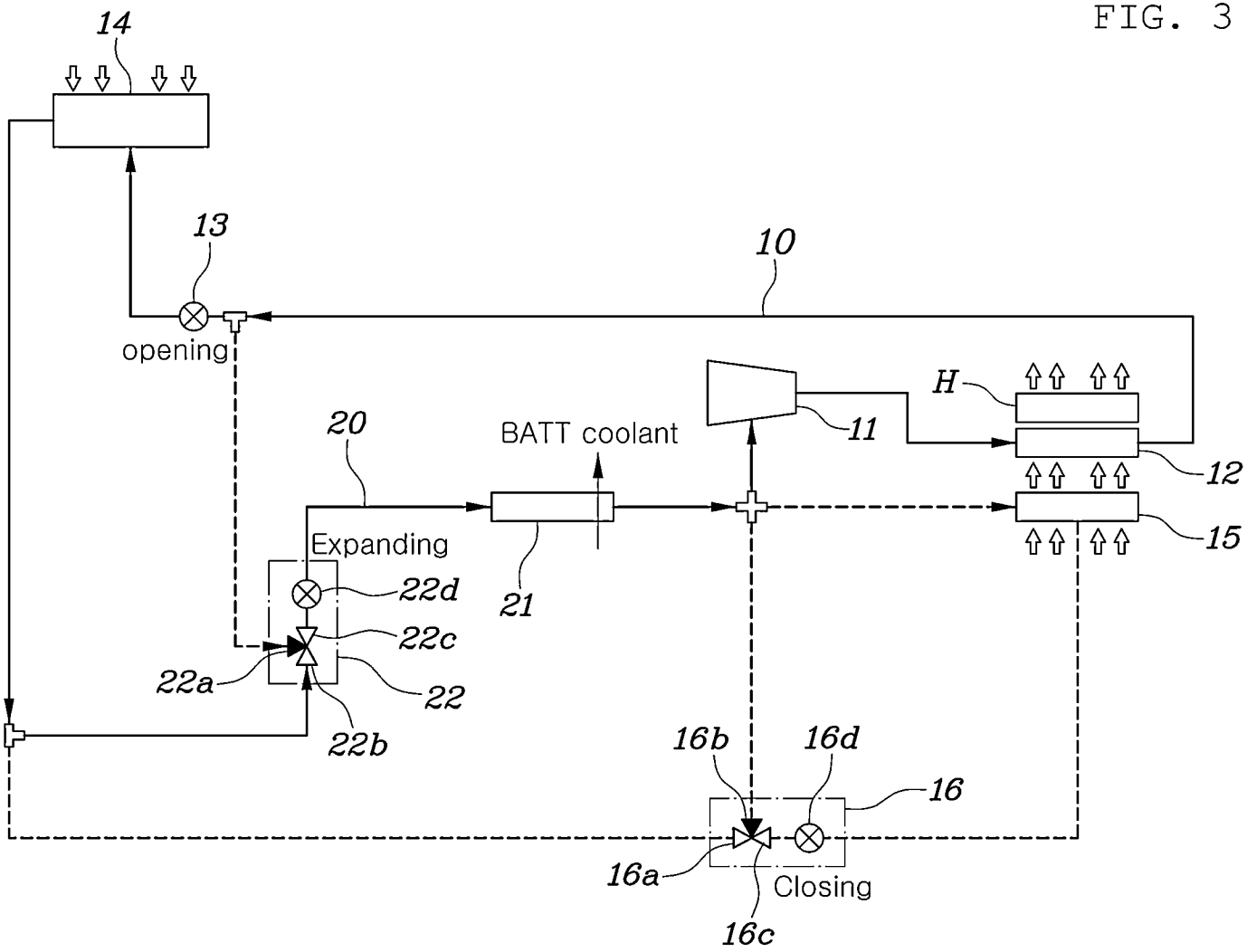
FIG. 3 is a view showing cooling of a cooling medium through a heat exchanger of the integrated thermal management system for a mobility shown in FIG. 1.
Figure 4:
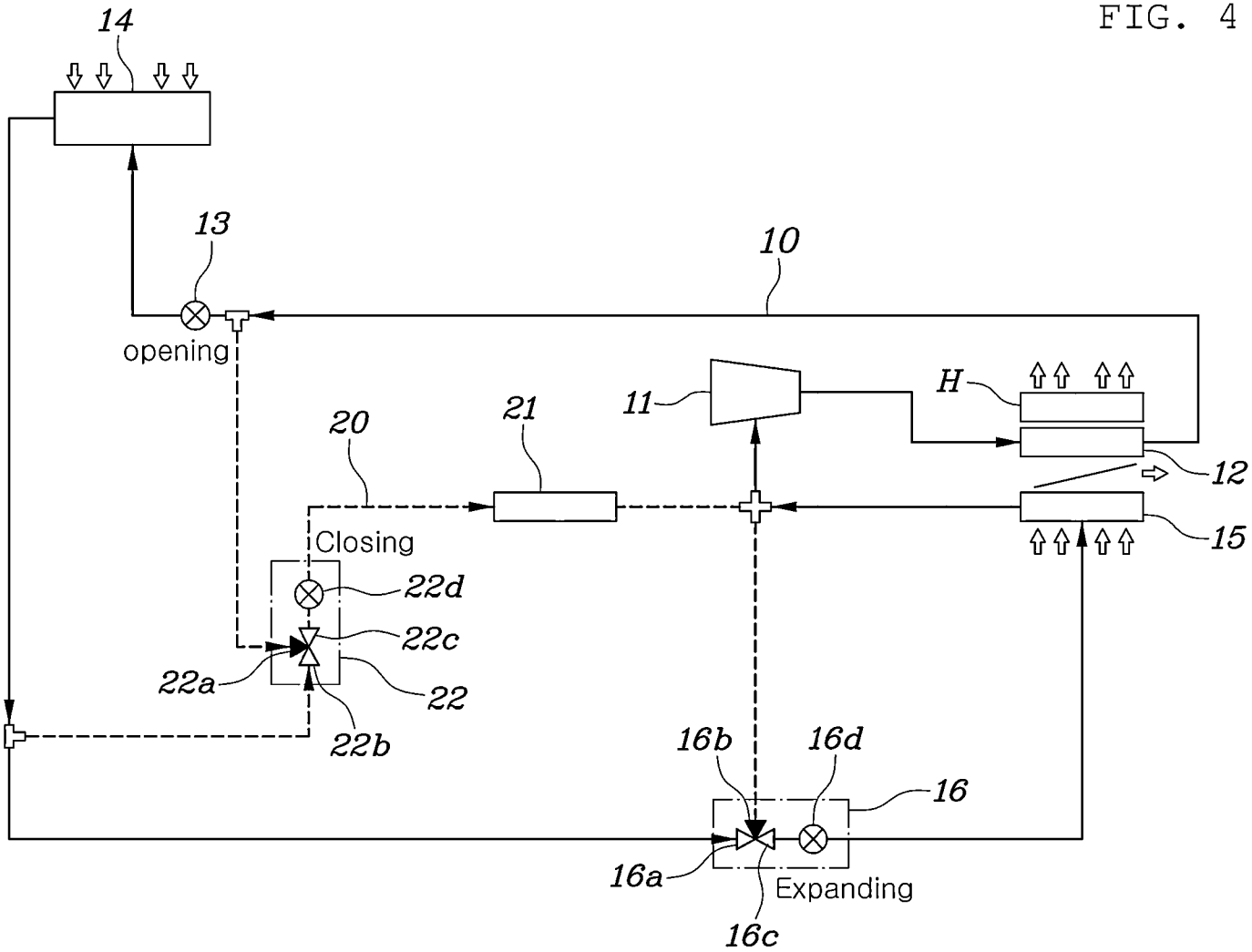
FIG. 4 is a view showing indoor cooling of the integrated thermal management system for a mobility shown in FIG. 1.
Figure 5:
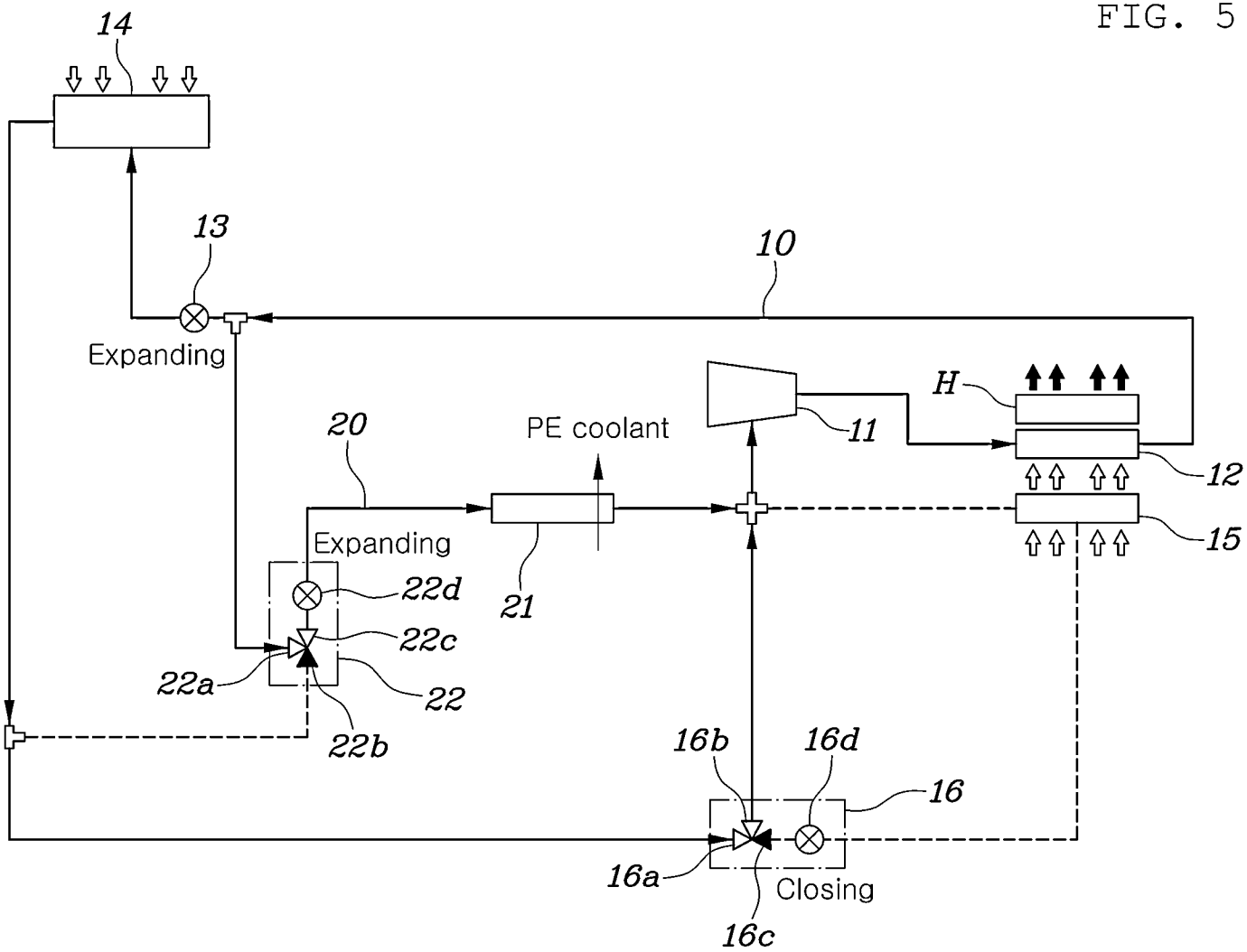
FIG. 5 is a view showing indoor heating according to an embodiment of the integrated thermal management system for a mobility shown in FIG. 1.

FIG. 1 is a circuit diagram of an integrated thermal management system for a mobility according to embodiments of the present disclosure. FIG. 2 is a block diagram of the integrated thermal management system for a mobility according to embodiments of the present disclosure. FIG. 3 is a view showing cooling of a cooling medium through a heat exchanger of the integrated thermal management system for a mobility shown in FIG. 1. FIG. 4 is a view showing indoor cooling of the integrated thermal management system for a mobility shown in FIG. 1. FIG. 5 is a view showing indoor heating according to an embodiment of the integrated thermal management system for a mobility shown in FIG. 1.

Figure 6:
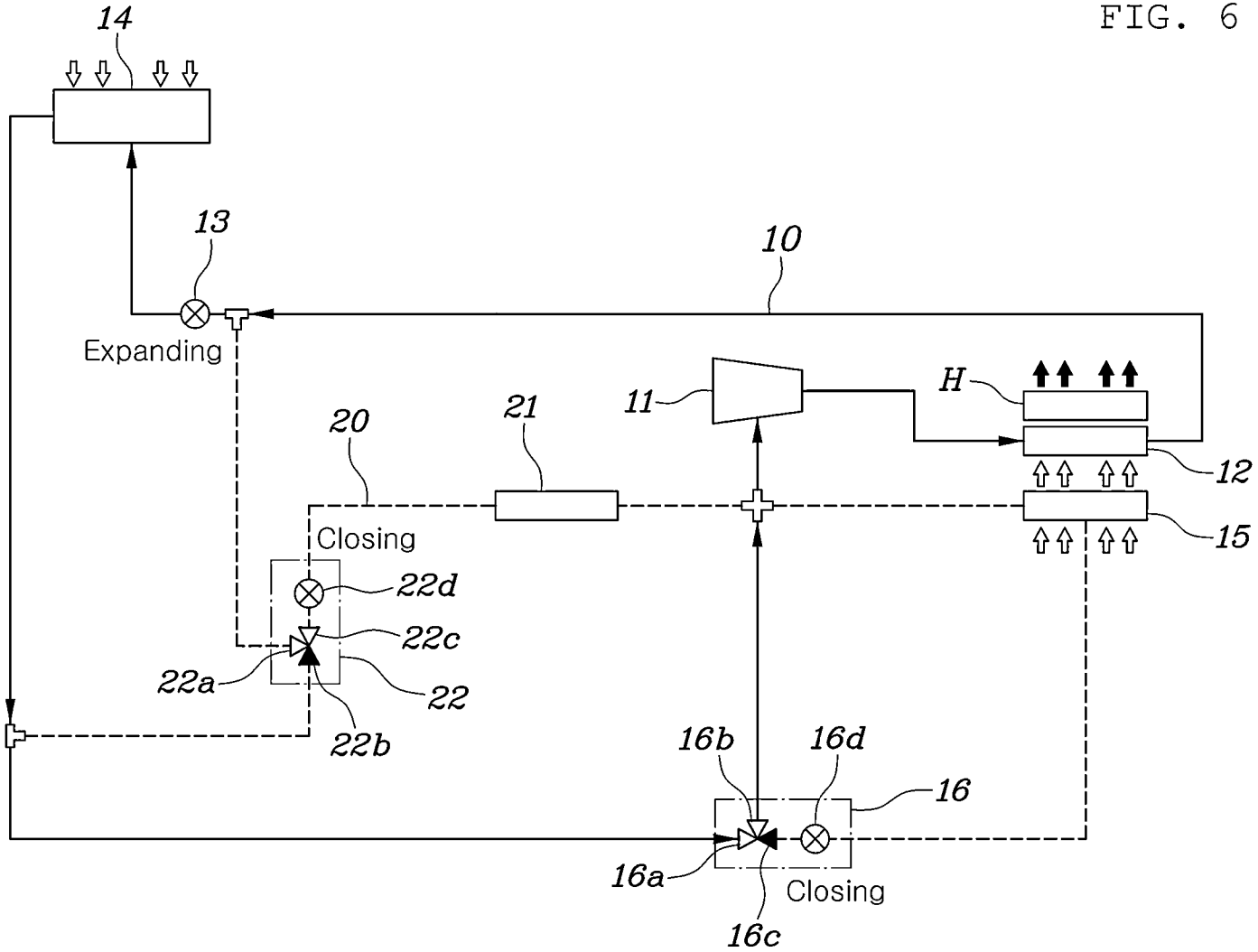
FIG. 6 is a view showing indoor heating according to a second embodiment of the integrated thermal management system for a mobility shown in FIG. 1.
Figure 7:
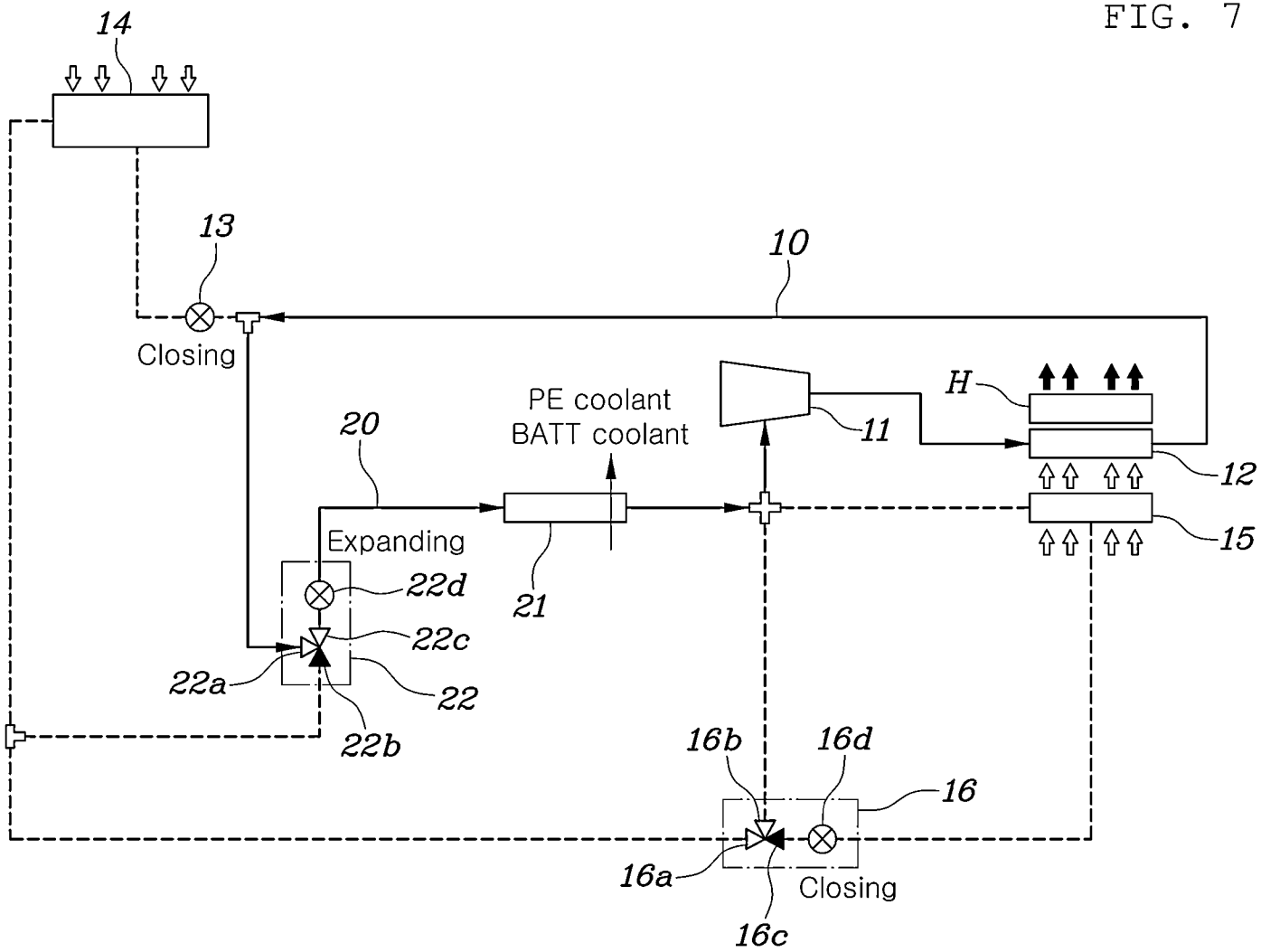
FIG. 7 is a view showing indoor heating according a third embodiment of the integrated thermal management system for a mobility shown in FIG. 1.

Furthermore, FIG. 6 is a view showing indoor heating according to a second embodiment of the integrated thermal management system for a mobility shown in FIG. 1. FIG. 7 is a view showing indoor heating according a third embodiment of the integrated thermal management system for a mobility shown in FIG. 1.

Figure 8:
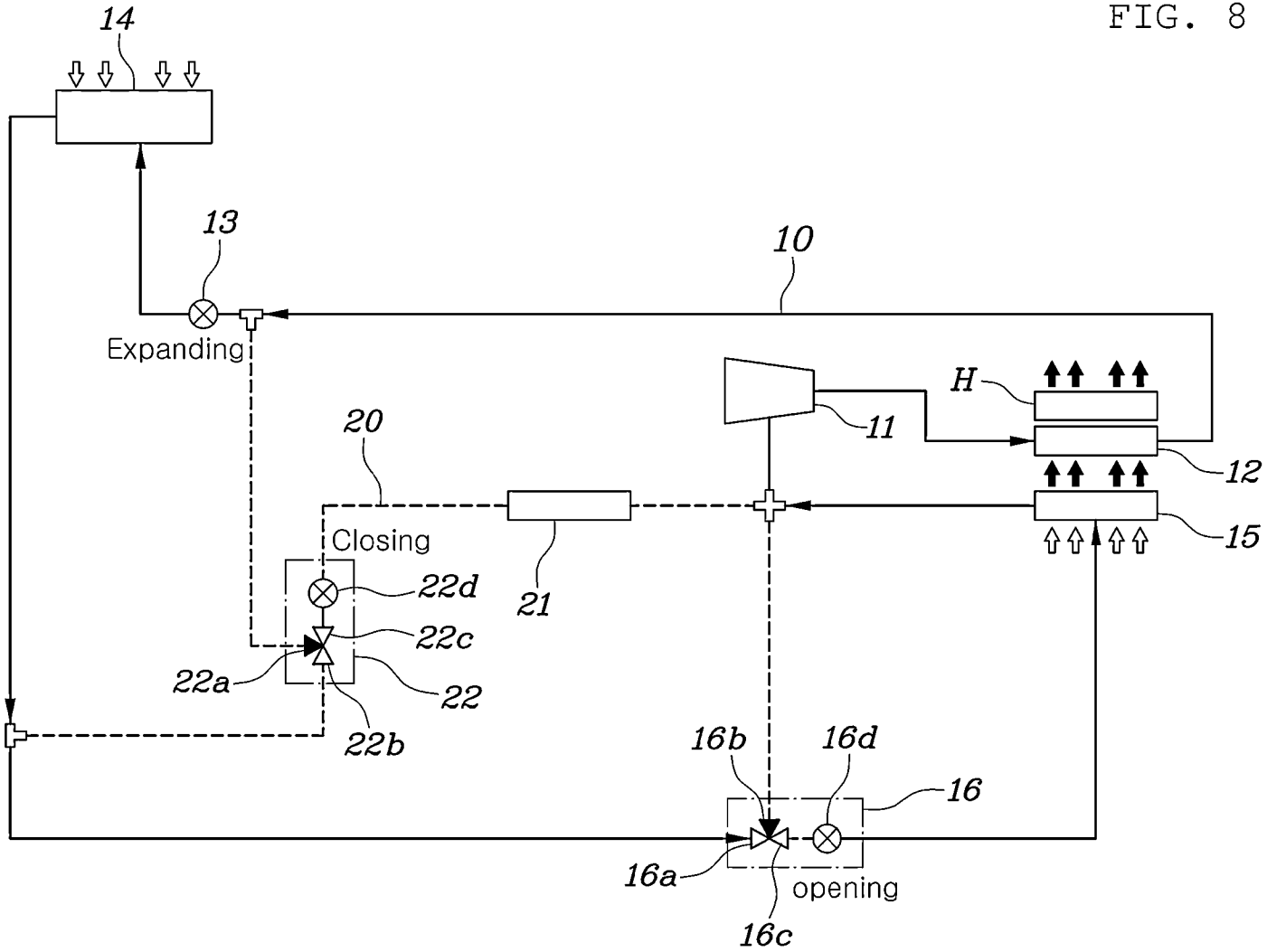
FIG. 8 is a view showing indoor heating and dehumidifying of the integrated thermal management system for a mobility shown in FIG. 1.
Figure 9:
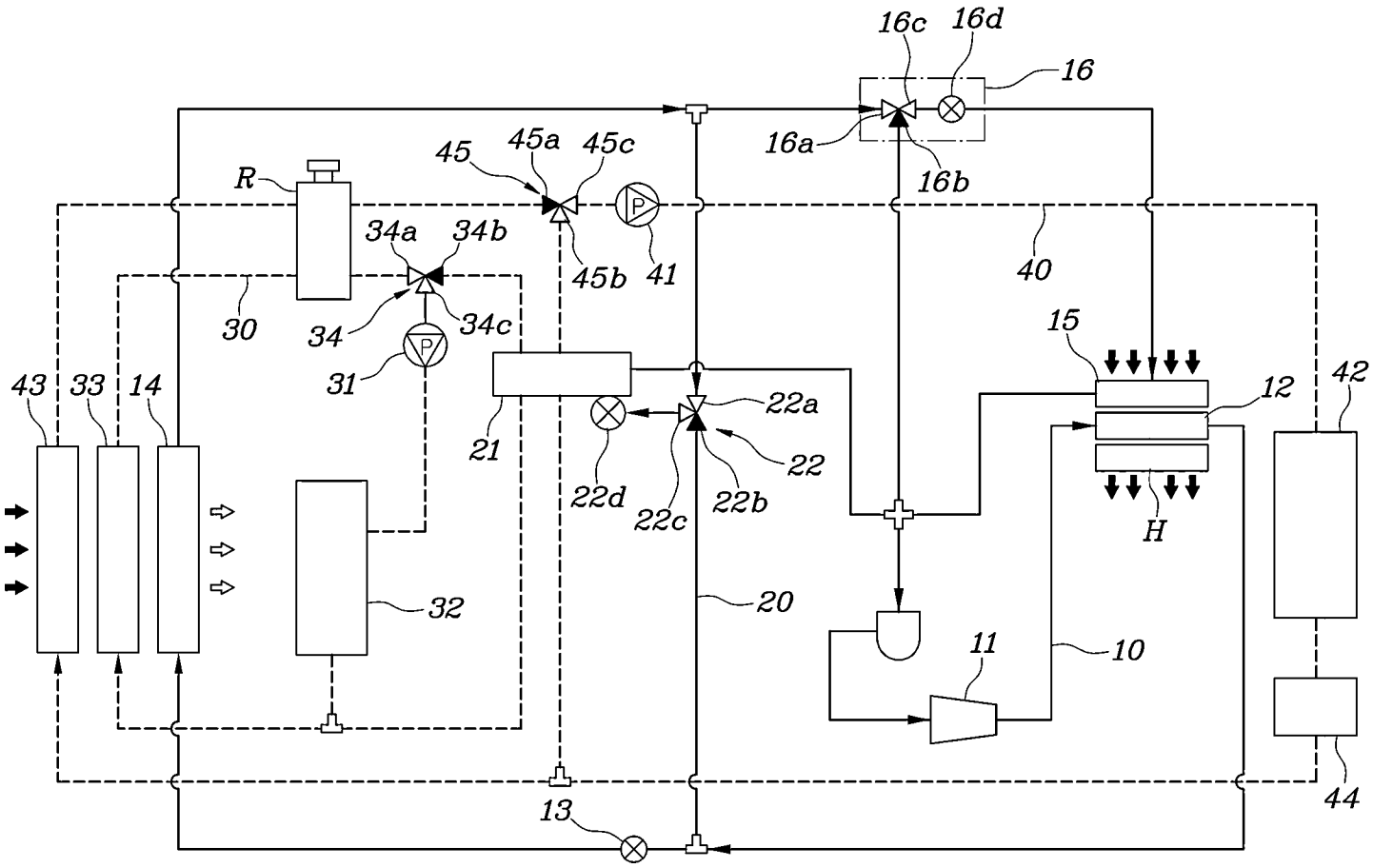
FIG. 9 is an entire circuit view according to an embodiment of the integrated thermal management system for a mobility according to embodiments of the present disclosure.

FIG. 8 is a view showing indoor heating and dehumidifying of the integrated thermal management system for a mobility shown in FIG. 1. FIG. 9 is an entire circuit view according to an embodiment of the integrated thermal management system for a mobility according to embodiments of the present disclosure.

Figure 10:
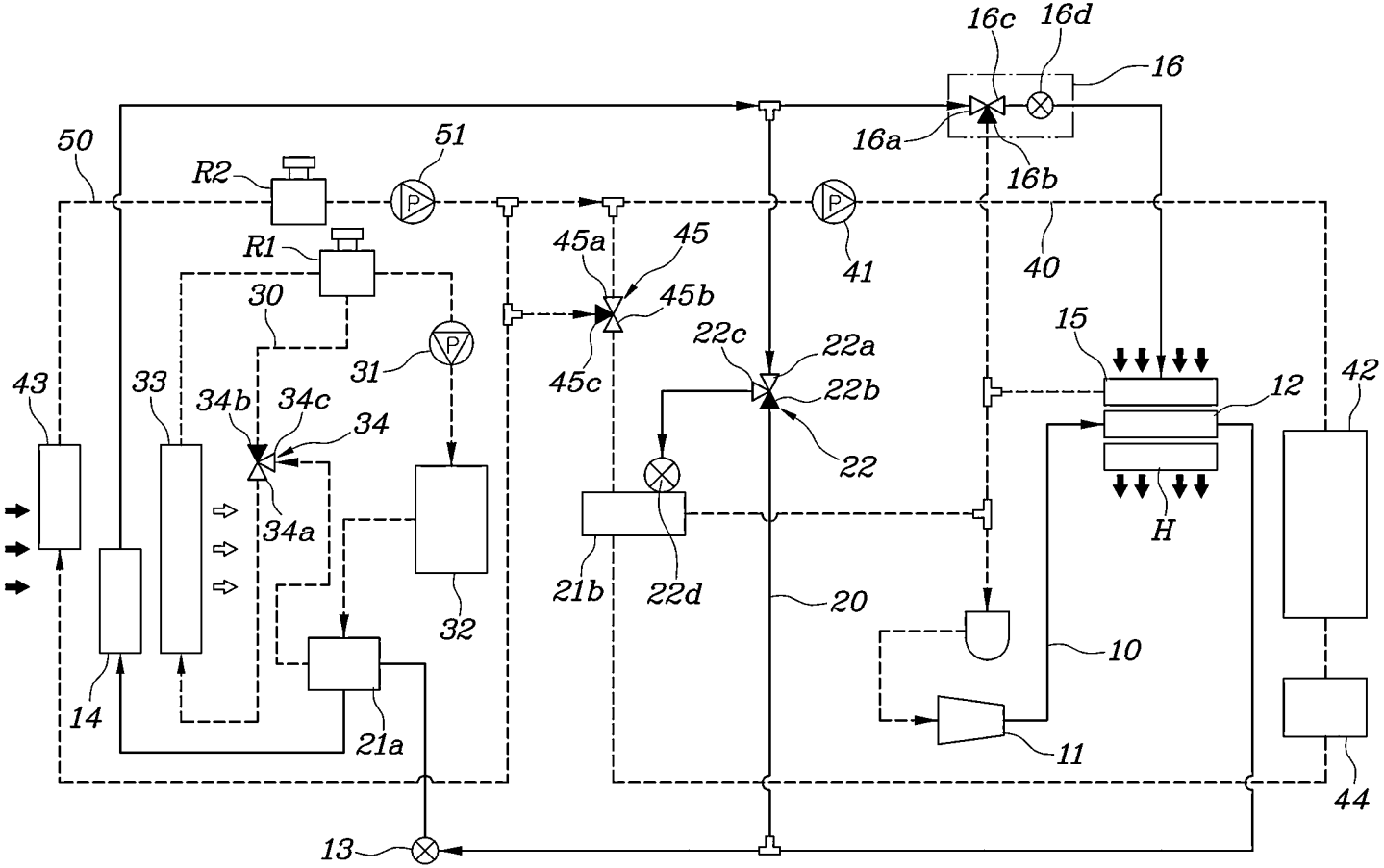
FIG. 10 is an entire circuit view according to a second embodiment of the integrated thermal management system for a mobility according to embodiments of the present disclosure.
Figure 11:
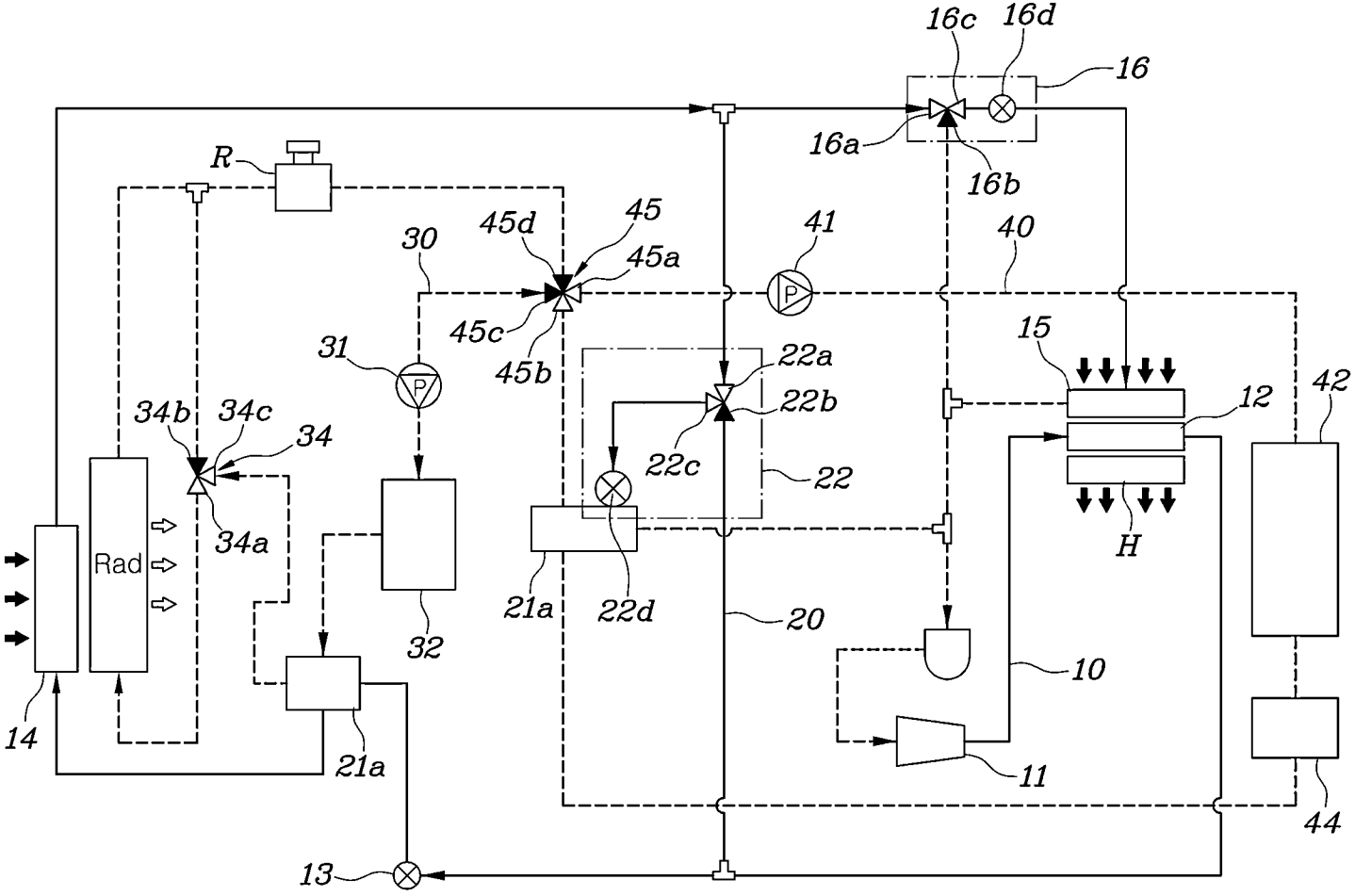
FIG. 11 is an entire circuit view according to a third embodiment of the integrated thermal management system for a mobility according to embodiments of the present disclosure.

Furthermore, FIG. 10 is an entire circuit view according to a second embodiment of the integrated thermal management system for a mobility according to embodiments of the present disclosure. FIG. 11 is an entire circuit view according to a third embodiment of the integrated thermal management system for a mobility according to embodiments of the present disclosure.

According to embodiments of the present disclosure, the integrated thermal management system for a mobility includes: as shown in FIG. 1, a first refrigerant line 10 through which a refrigerant is circulated, including a compressor 11, an indoor condenser 12, an expansion valve 13, an outdoor condenser 14, and an evaporator 15, and including a first flow control valve 16 arranged between the outdoor condenser 14 and the evaporator and configured to selectively expand a distribution direction of the refrigerant and the refrigerant; and a second refrigerant line 20 including a heat exchanger 21 arranged at a front end of the compressor 11 and configured to perform heat exchange with another cooling medium, which branches from both of a front end and a rear end of the outdoor condenser 14 and the branching liens merge together and then are connected to a front end of the heat exchanger 21, the second refrigerant line including a second flow control valve 22 arranged at a merging point of the branching lines and configured to selectively expand the distribution direction of the refrigerant and the refrigerant.

In embodiments of the present disclosure, the first refrigerant line 10 and the second refrigerant line 20 share the refrigerant, and as the refrigerant is circulated, heating air or cooling air may be generated.

In other words, the refrigerant of high pressure and high temperature, which is compressed by the compressor 11, may perform heat exchange with air through the indoor condenser 12, thereby generating heating air. Here, in addition to the indoor condenser 12, a PTC heater H is provided to replenish indoor heating energy, thereby adjusting the temperature of heating air. Furthermore, according to embodiments of the present disclosure, cooling air may be supplied through the evaporator 15. As described above, heating air and cooling air generated by the indoor condenser 12 and the evaporator 15 are discharged into the indoor space through conditioning equipment, thereby supplying conditioning air depending on indoor desired temperature.

Specifically, according to embodiments of the present disclosure, the refrigerant line is divided into the first refrigerant line 10 and the second refrigerant line 20, and the first refrigerant line 10 includes the outdoor condenser 14, and the heat exchanger is arranged on the second refrigerant line 20 so that the outdoor condenser 14 and the heat exchanger 21 are arranged in parallel to each other. According to embodiments of the present disclosure, the first flow control valve 16 and the second flow control valve 22 adjust a flow of the refrigerant and an expansion status of the refrigerant, so that various thermal management modes including heating, cooling, dehumidifying, and cooling of parts may be efficiently realized.

In other words, for waste heat recovery of the electronic part, a conventional outdoor condenser should include an expansion valve facilitating evaporation of a refrigerant, a direction changing valve selectively bypassing the refrigerant at a front end of an outdoor condenser, an expansion valve facilitating evaporation of the refrigerant for cooling a coolant of a battery, a blocking valve bypassing the refrigerant into an evaporator for dehumidifying the indoor space, and an expansion valve facilitating evaporation of the refrigerant for cooling indoor air in the evaporator. Accordingly, the multiple expansion valves and direction changing valves are required and multiple refrigerant pipes connecting the valves to each other increases, so that a manufacturing cost of a vehicle increases and spatial utilization of an engine room is reduced. Specifically, in heating through a heat pump, the heat exchanger promoting evaporation of the refrigerant and an air cooling condenser are connected to each other in series, and a pressure of the refrigerant increases and a temperature of the refrigerant increases, so heating efficiency is reduced.

However, according to embodiments of the present disclosure, as the refrigerant line is divided into the first refrigerant line 10 and the second refrigerant line 20 and the outdoor condenser 14 is provided on the first refrigerant line and the heat exchanger is arranged on the second refrigerant line 20, the outdoor condenser 14 and the heat exchanger 21 are arranged in a parallel structure. Therefore, compared to the refrigerant circuit in which the refrigerant may need to pass through the heat exchanger after the outdoor condenser, the refrigerant pipe is shortened, so that a resistance of the refrigerant is reduced and heating efficiency increases.

In other words, on the first refrigerant line 10, the second refrigerant line 20 forms a bypass path and both of the first flow control valve 16 and the second flow control valve 22 changes a distribution flow of the refrigerant and an expansion status of the refrigerant, so that in indoor heating, the refrigerant may be distributed into both of the outdoor condenser 14 and the heat exchanger 21, or selectively into any one of the outdoor condenser 14 and the heat exchanger 21, and thermal management for the indoor heating can be efficiently performed in response to various situations.

In describing embodiments of the above-mentioned present disclosure in detail, the expansion valve 13 on the first refrigerant line 10 is arranged at a portion in rear of a front branching point of the outdoor condenser 14 on the second refrigerant line 20. In other words, depending on whether or not fully opening, expanding-opening, and closing of the expansion valve 13 are operated, the refrigerant distributed in the first refrigerant line 10 may be distributed into the outdoor condenser 14 or into the second refrigerant line 20. Accordingly, when the expansion valve 13 performs fully opening or expanding-opening, the refrigerant is distributed into the outdoor condenser 14 so as to perform heat exchange with external air, and when the expansion valve 13 perform closing operation, the refrigerant may be distributed from the first refrigerant line 10 into the second refrigerant line 20.

Meanwhile, the first flow control valve 16 includes a first port 16*a* toward the outdoor condenser 14, a second port 16*b* toward the compressor 11, and a third port 16*c* toward the evaporator 15, and the third port 16*c* includes a first expander 16*d* so as to selectively expand the refrigerant.

As described above, the first flow control valve 16 may be formed into a 3-way valve, and the refrigerant that has passed through the outdoor condenser 14 may be selectively distributed into the compressor 11 or the evaporator 15 in response to whether or not openings of the first port 16*a*, the second port 16*b*, the third port 16*c* are performed. Specifically, as the first expander 16*d* is provided at the third port 16*c* of the first flow control valve 16 toward the evaporator 15, the refrigerant distributed through the third port 16*c* may be distributed into the evaporator 15 while expanding by the first expander 16*d* or is prevented from being distributed. The first expander 16*d* may be provided integrally with the third port 16*c*, or may be spaced apart from the first refrigerant line 10.

Meanwhile, the second flow control valve 22 includes a fourth port 22*a* toward the front end of the outdoor condenser 14, a fifth port 22*b* toward the rear end of the outdoor condenser 14, and a sixth port 22*c* toward the heat exchanger 21, and the sixth port 22*c* includes a second expander 22*d* so as to selectively expand the refrigerant.

As described above, the second flow control valve 22 may be formed into a 3-way valve, and in response to whether or not openings of the fourth port 22*a*, the fifth port 22*b*, and the sixth port 22*c* are performed, the refrigerant before being distributed into the outdoor condenser 14 or the refrigerant after being distributed thereinto in the first refrigerant line may be selectively distributed into the heat exchanger 21. Specifically, as the second expander 22*d* is provided at the sixth port 22*c* of the second flow control valve 22 toward the heat exchanger 21, the refrigerant distributed through the sixth port 22*c* may expand by the second expander 22*d* and be distributed into the heat exchanger 21 or may be prevented from being distributed. The second expander 22*d* may be provided integrally with the sixth port 22*c*, or may be spaced apart from the second refrigerant line 20.

As described above, the compressor 11, the expansion valve 13, the first flow control valve 16, and the second flow control valve 22 may be controlled by a controller 100 in response to a thermal management mode and operation thereof may be determined. Here, the thermal management mode may include a cooling/heating mode of an electronic part 32, a cooling/heating mode of a battery 42, and an indoor cooling/heating mode. Specifically, according to embodiments of the present disclosure, in realizing heating through the heat pump, the refrigerant circuit may be reduced and a valve structure is simplified, and the efficiency of heating mode is secured.

With the structure according to embodiments of the present disclosure described above, in embodiments, in response to the thermal management mode, the system may operate as follows. The embodiments will be described in detail as follows.

As shown in FIG. 3, when the cooling medium is cooled through the heat exchanger 21, the controller 100 controls the expansion valve 13 to be opened, and in the first flow control valve 16, the second port 16*b* to be closed and the first expander 16*d* to perform closing operation, and in the second flow control valve 22, both of the fifth port 22*b* and the sixth port 22*c* are opened and the second expander 22*d* performs expanding operation.

Here, the cooling medium may be a coolant, and after the cooling medium cools the battery 42 or the electronic part 32, the cooling medium performs heat exchange with the refrigerant through the heat exchanger 21, so that the temperature thereof is adjusted so as to cool the battery 42 or the electronic part 32.

As described above, in cooling the cooling medium, in the first flow control valve 16, the second port 16*b* is closed and the first expander 16*d* performs closing operation, so that the refrigerant is prevented from being distributed into the evaporator 15. Furthermore, the refrigerant that has been compressed through the compressor 11 passes through the indoor condenser 12 and then is distributed into the heat exchanger 21 through both of the fifth port 22*b* and the sixth port 22*c* of the second flow control valve 22. Herein, in the second flow control valve 22, as the second expander 22*d* performs expanding operation, the heat exchanger 21 absorbs heat of the cooling medium, so that the temperature of the cooling medium may be adjusted so as to cool the battery 42 or the electronic part 32.

Meanwhile, as shown in FIG. 4, in indoor cooling, the controller 100 controls the expansion valve 13 to be opened, in the first flow control valve 16, both of the first port 16*a* and the third port 16*c* to be opened and the first expander 16*d* to perform an expanding operation, and in the second flow control valve 22, the fourth port 22*a* to be closed and the second expander 22*d* to perform closing operation.

In other words, in indoor cooling, as the expansion valve 13 is opened and the fourth port 22*a* of the second flow control valve 22 is closed, the refrigerant compressed by the compressor 11 passes through the indoor condenser 12 and the outdoor condenser 14 and is condensed. Here, the second expander 22*d* of the second flow control valve 22 performs closing operation and distribution of the refrigerant toward the heat exchanger 21 is prevented. Furthermore, in the first flow control valve 16, as both of the first port 16*a* and the third port 16*c* are opened and the first expander 16*d* performs expanding operation, the evaporator 15 absorbs external heat, thereby generating cooling air. Accordingly, cooling air required in indoor cooling may be provided.

Meanwhile, according to embodiments of the present disclosure, in indoor heating, as both of the outdoor condenser 14 and the heat exchanger 21 are efficiently operated, the efficiency of energy in indoor heating can be secured for each situation.

According to an embodiment of indoor heating, as shown in FIG. 5, in indoor heating, the controller 100 controls the expansion valve 13 to perform an expanding operation, in the first flow control valve 16, both of the first port 16*a* and the second port 16*b* to be opened and the first expander 16*d* to perform closing operation, and in the second flow control valve 22, both the fourth port 22*a* and the sixth port 22*c* to be opened and the second expander 22*d* to perform an expanding operation.

In other words, the refrigerant compressed by the compressor 11 generates heating air as the indoor condenser 12 provides heat to external air. After, as the expansion valve 13 is opened, some of the refrigerant absorbs external heat due to evaporation in the outdoor condenser 14, and a remaining refrigerant is distributed toward the heat exchanger 21 through the fourth port 22*a* and the sixth port 22*c* of the second flow control valve 22. Here, the second expander 22*d* performs expanding operation, thereby absorbing heat of the cooling medium in the heat exchanger 21. As described above, as the refrigerant absorbs heat through the outdoor condenser 14 and the heat exchanger 21, when the refrigerant is distributed into the compressor 11 and is distributed into the indoor condenser 12, heat for heating is secured and the efficiency of heating is improved.

Meanwhile, according to a second embodiment of indoor heating, as shown in FIG. 6, in indoor heating, the controller 100 controls the expansion valve 13 to perform an expanding operation, and in the first flow control valve 16, both of the first port 16*a* and the second port 16*b* to be opened and the first expander 16*d* to perform closing operation, and in the second flow control valve 22, the fourth port 22*a* to be closed and the second expander 22*d* to perform closing operation.

In other words, the refrigerant compressed by the compressor 11 generates heating air as the indoor condenser 12 provides heat to external air. After, as the expansion valve 13 is opened, the refrigerant heat-absorbs external heat due to evaporation in the outdoor condenser 14 and then is recirculated into the compressor 11, so that heat for heating is secured in the indoor condenser 12 and the efficiency of heating is improved. Furthermore, in the embodiment of heating, the efficiency of heating is secured by absorbing only external heat through the outdoor condenser 14, so that heat exchange with the cooling medium is not performed through the heat exchanger 21 and the indoor heating mode may be selectively performed in response to the temperature of the electronic part 32 or the battery 42 and heat exchange efficiency of external air through the outdoor condenser 14.

Furthermore, according to a third embodiment of indoor heating, as shown in FIG. 7, in indoor heating, the controller 100 controls the expansion valve 13 to perform closing operation, and in the second flow control valve 22, both the fourth port 22*a* and the sixth port 22*c* to be opened and the second expander 22*d* to perform an expanding operation.

In other words, the refrigerant compressed by the compressor 11 generates heating air as the indoor condenser 12 provides heat to external air. After, as the expansion valve 13 performs closing operation, the refrigerant is distributed from the first refrigerant line 10 into the second refrigerant line 20, and the fourth port 22*a* and the sixth port 22*c* of the second flow control valve 22 are opened and the second expander 22*d* expands, so that the heat exchanger 21 absorbs heat of the cooling medium and the heating efficiency performed through the indoor condenser 12 is improved. Furthermore, in the third embodiment of heating, the efficiency of heating is secured by absorbing only heat of the cooling medium through the heat exchanger 21, so that heat exchange of with the cooling medium is performed through the heat exchanger 21, and the indoor heating mode may be selectively performed in response to temperature of the electronic part 32 or the battery 42 and heat exchange efficiency of external air through the outdoor condenser 14.

Meanwhile, in indoor heating and dehumidifying, the controller 100 controls the expansion valve 13 to perform an expanding operation, in the first flow control valve 16, both of the first port 16*a* and the third port 16*c* to be opened and the first expander 16*d* to perform an expanding operation, and in the second flow control valve 22, the fourth port 22*a* to be closed and the second expander 22*d* to perform closing operation.

As shown in FIG. 8, the refrigerant compressed by the compressor 11 provides heat to external heat in the indoor condenser 12 to generate heating air. Furthermore, the expansion valve 13 operates expanding operation, and the first port 16*a* and the third port 16*c* of the first flow control valve 16 are opened, so that indoor air is dehumidified through the evaporator 15. Here, as the expansion valve 13 expands and a predetermined amount of evaporation is performed in the outdoor condenser 14, discomfort due to supercooling of conditioning air in the evaporator 15 is eliminated, and heating air required in the indoor space can be supplied. Accordingly, conditioning air in response to indoor heating and dehumidifying can be supplied into the indoor space.

As described above, systems and methods according to embodiments of the present disclosure can efficiently realize various thermal management modes including heating, cooling, dehumidifying, and cooling of parts, such that the first refrigerant line 10 and the second refrigerant line 20 branch, and the outdoor condenser 14 is provided on the first refrigerant line 10 and the heat exchanger 21 is arranged on the second refrigerant line 20, so that the outdoor condenser 14 and the heat exchanger 21 are arranged in parallel to each other, and a flow and an expanding status of the refrigerant of the first flow control valve 16 and the second flow control valve 22 are adjusted.

Meanwhile, as shown in FIG. 9, a system according to embodiments of the present disclosure includes: a first coolant line 30 configured to distribute a coolant into a first water pump 31, the electronic part 32, the heat exchanger 21, a first radiator 33, and a reservoir R, and including a first coolant valve 34 configured to selectively distribute the coolant into the electronic part 32, the heat exchanger 21, and the first radiator 33; a second coolant line 40 configured to distribute the coolant into a second water pump 41, the battery 42, the heat exchanger 21, a second radiator 43, and the reservoir R, and including a second coolant valve 45 configured to selectively distribute the coolant into the battery 42, the heat exchanger 21, and the second radiator 43; the first refrigerant line 10 configured to distribute the refrigerant into the compressor 11, the indoor condenser 12, the expansion valve 13, the outdoor condenser 14, and the evaporator 15, and including the first flow control valve 16 arranged between the outdoor condenser 14 and the evaporator 15 and configured to selectively expand a distribution direction of the refrigerant and the refrigerant; and the second refrigerant line 20, which branches from both of the front end and the rear end of the outdoor condenser 14 and the branching lines merge together and then are connected to the front end of the heat exchanger 21, the second refrigerant line 20 including the second flow control valve 22 arranged in a merging point of the branching lines and configured to selectively expand a distribution direction of the refrigerant and the refrigerant.

As described above, in the first coolant line 30, when the first water pump 31 is performs, the coolant is circulated into the electronic part 32, the heat exchanger 21, and the first radiator 33 and performs heat exchange, and in the second coolant line 40, when the second water pump 41 is operated, the coolant is circulated into the battery 42 and the heat exchanger 21 and performs heat exchange. Here, a coolant heater 44 is provided on the second coolant line 40, so that the coolant circulated in the second coolant line 40 may be adjusted in temperature.

Furthermore, the first coolant valve 34 provided in the first coolant line 30 selectively allows a flow of the coolant distributed into the first radiator 33 in the first coolant line 30.

Furthermore, the first coolant line 30 and the second coolant line 40 are connected to each other by the second coolant valve 45 as a medium, and in response to coolant flow control of the second coolant valve 45, the coolant is separately circulated in the first coolant line 30 and the second coolant line 40, or may be integrally circulated in the first coolant line 30 and the second coolant line 40.

In other words, the first coolant valve 34 may include a first coolant port 34*a* toward the first radiator 33, a second coolant port 34*b* toward the heat exchanger 21, and a third coolant port 34*c* toward the electronic part 32, and the second coolant valve 45 may include a fourth coolant port 45*a* toward the second radiator 43, a fifth coolant port 45*b* toward the heat exchanger 21, and a sixth coolant port 45*c* toward the battery 42.

Furthermore, the first flow control valve includes the first port 16*a* toward the outdoor condenser 14, the second port 16*b* toward the compressor 11, and the third port 16*c* toward the evaporator 15, and the third port 16*c* includes the first expander 16*d* so that the refrigerant selectively expands. The second flow control valve 22 includes the fourth port 22*a* toward the front end of the outdoor condenser 14, the fifth port 22*b* toward the rear end of the outdoor condenser 14, and the sixth port 22*c* toward the heat exchanger 21, and the sixth port 22*c* includes the second expander 22*d* so that the refrigerant selectively expands.

According to embodiments of the present disclosure, as the first coolant valve 34, the second coolant valve 45, the first flow control valve 16, and the second flow control valve 22 are controlled, the various thermal management modes such as cooling of the electronic part 32 by external air, cooling of the battery 42, or indoor heating or cooling can be realized.

Furthermore, as the first radiator 33 for cooling the electronic part 32 and the second radiator 43 for cooling the battery 42 are provided, the cooling performance of both of the electronic part 32 and the battery 42 is secured, and as the second coolant valve 45 is controlled so as to connect the first coolant line 30 to the second coolant line 40 in series or parallel, the desired coolant may be used only by the single reservoir R.

In addition, systems and methods according to embodiments of the present disclosure can efficiently realize various thermal management modes including heating, cooling, dehumidifying, and cooling of parts such that the first refrigerant line 10 including the outdoor condenser 14 and the second refrigerant line 20 including the heat exchanger 21 branch from each other to allow the outdoor condenser 14 and the heat exchanger 21 to be arranged in parallel to each other, so that a flow and an expansion status of refrigerant of the first flow control valve 16 and the second flow control valve 22 are adjusted.

Meanwhile, as shown in FIG. 10, a system according to embodiments of the present disclosure includes: the first coolant line 30 configured to distribute the coolant into the first water pump 31, the electronic part 32, a first heat exchanger 21*a*, the first radiator 33, and a first reservoir R1, and including the first coolant valve 34 arranged between the first heat exchanger 21*a* and the first radiator 33; the second coolant line 40 configured to distribute the coolant into the second water pump 41, the battery 42, and a second heat exchanger 21*b*; a third coolant line 50 configured to distribute the coolant into a third water pump 51, the second radiator 43, and a second reservoir R2, and connected to the second coolant line 40 by the second coolant valve 45 as a medium; the first refrigerant line 10 configured to distribute the refrigerant into the compressor 11, the indoor condenser 12, the expansion valve 13, the first heat exchanger 21*a*, the outdoor condenser 14, and the evaporator 15, and including the first flow control valve 16 arranged between the outdoor condenser 14 and the evaporator 15 and configured to selectively expand a distribution direction of the refrigerant and the refrigerant; and the second refrigerant line 20, which branches from both of a front end of the first heat exchanger 21*a* and the rear end of the outdoor condenser 14 and the branching lines merge together, and then the merging line is connected to a front end of the second heat exchanger 21*b*, the second refrigerant line including the second flow control valve 22 arranged on a merging point of the branching lines and configured to selective expand the flow direction of the refrigerant and the refrigerant.

Here, the first heat exchanger 21*a* is configured to exchange heat between the refrigerant and the coolant in the first coolant line 30, and the second heat exchanger 21*b* is configured to exchange heat between the refrigerant and the coolant in the second coolant line 40. Furthermore, as a plurality of reservoirs R is provided in the coolant lines, management of the coolant is easily performed in the each coolant line. Furthermore, the first reservoir R1 is arranged in front of the first water pump 31 and the second reservoir R2 is arranged in front of the third water pump 51, so that in the each coolant line, installation positions of the water pump and the reservoir R are separated to facilitate configuration of the entire module package. Furthermore, the each reservoir R is arranged in front of the each water pump, so that an air vent performance through the each reservoir R is improved and the reservoir R and the valve is easily configured into an integrated module.

As described above, in the first coolant line 30, when the first water pump 31 is performs, the coolant is circulated into the electronic part 32, the first heat exchanger 21*a*, and the first radiator 33 and performs heat exchange, and in the second coolant line 40, when the second water pump 41 is operated, the coolant is circulated into the battery 42 and the heat exchanger 21 and performs heat exchange. Here, a coolant heater 44 is provided on the second coolant line 40, so that the coolant circulated in the second coolant line 40 may be adjusted in temperature. Furthermore, in the third coolant line 50, when the third water pump 51 is operated, the coolant is circulated into the second radiator 43 and the second reservoir R2 and performs heat exchange, and the third coolant line 40 is connected to the second coolant line 40 by the second coolant valve 45 as a medium, so that the coolant may be separately circulated in the second coolant line 40 and the third coolant line 50 or may be integrally circulated in the second coolant line 40 and the third coolant line 50 by coolant flow control of the second coolant valve 45. In other words, in the embodiment, the coolant to manage temperature of each of the electronic part 32 and the battery 42 is separated.

Accordingly, the first coolant valve 34 includes the first coolant port 34*a* toward a front end of the first radiator 33, the second coolant port 34*b* toward a rear end of the first radiator 33, and the third coolant port 34*c* toward the first heat exchanger 21*a*, and the second coolant valve 45 may include the fourth coolant port 45*a* toward a front end of the battery 42, the fifth coolant port 45*b* toward a rear end of the second heat exchanger 21*b*, and the sixth coolant port 45*c* toward the second radiator 43.

Furthermore, the first flow control valve 16 includes the first port 16*a* toward the outdoor condenser 14, the second port 16*b* toward the compressor 11, and the third port 16*c* toward the evaporator 15, and the third port 16*c* includes the first expander 16*d* so that the refrigerant selectively expands. The second flow control valve 22 may include the fourth port 22*a* toward the front end of the first heat exchanger 21*a*, the fifth port 22*b* toward the rear end of the outdoor condenser 14, and the sixth port 22*c* toward the second heat exchanger 21*b*, and the sixth port 22*c* includes the second expander 22*d* so that the refrigerant selectively expands.

According to embodiments of the present disclosure, as the first coolant valve 34, the second coolant valve 45, the first flow control valve 16, and the second flow control valve 22 are controlled, the various thermal management modes such as cooling of the electronic part 32 by external air, cooling of the battery 42, or indoor heating or cooling can be realized. Furthermore, as the second radiator 43 is provided to cool the first radiator 33 and the battery 42 to cool the electronic part 32, the cooling performance of each of the electronic part 32 and the battery 42 is secured.

In addition, systems and methods according to embodiments of the present disclosure can efficiently realize various thermal management modes including heating, cooling, dehumidifying, and cooling of parts such that the first refrigerant line 10 including the outdoor condenser 14 and the second refrigerant line 20 including the heat exchanger 21 branch from each other to allow the outdoor condenser 14 and the heat exchanger 21 to be arranged in parallel to each other, so that a flow and an expansion status of refrigerant of the first flow control valve 16 and the second flow control valve 22 are adjusted.

Meanwhile, as shown in FIG. 11, a system according to embodiments of the present disclosure includes: the first coolant line 30 configured to distribute the coolant into the first water pump 31, the electronic part 32, the first heat exchanger 21*a*, the radiator, and the reservoir R, and including the first coolant valve 34 between the first heat exchanger 21*a* and the radiator; the second coolant line 40 configured to distribute the coolant into the second water pump 41, the battery 42, and the second heat exchanger 21*b*, and connected to the first coolant line 30 by the second coolant valve 45 as a medium; the first refrigerant line 10 configured to distribute the refrigerant into the compressor 11, the indoor condenser 12, the expansion valve 13, the first heat exchanger 21*a*, the outdoor condenser 14, and the evaporator 15, and including the first flow control valve 16 arranged between the outdoor condenser 14 and the evaporator 15 and configured to selectively expand the distribution direction of the refrigerant and the refrigerant; and the second refrigerant line 20, which branches from both of the front end of the first heat exchanger 21*a* and the rear end of the outdoor condenser 14 and the branching lines merge together and then are connected to the front end of the second heat exchanger 21*b*, the second refrigerant line 20 including the second flow control valve 22 arranged on a merging point of the branching lines and configured to selectively expand the distribution direction of the refrigerant and the refrigerant.

As described above, in the first coolant line 30, when the first water pump 31 is performs, the coolant is circulated into the electronic part 32, the heat exchanger 21, and the first radiator 33 and performs heat exchange, and in the second coolant line 40, when the second water pump 41 is operated, the coolant is circulated into the battery 42 and the heat exchanger 21 and performs heat exchange. Here, a coolant heater 44 is provided on the second coolant line 40, so that the coolant circulated in the second coolant line 40 may be adjusted in temperature.

Furthermore, the first coolant valve 34 provided in the first coolant line 30 selectively allows a flow of the coolant distributed into the first radiator 33 in the first coolant line 30.

Furthermore, the first coolant line 30 and the second coolant line 40 are connected to each other by the second coolant valve 45 as a medium, and in response to coolant flow control of the second coolant valve 45, the coolant is separately circulated in the first coolant line 30 and the second coolant line 40, or may be integrally circulated in the first coolant line 30 and the second coolant line 40.

Specifically, as the radiator is provided as one integrated radiator and the second coolant valve 45 is controlled the first coolant line 30 and the second coolant line 40 are connected to each other in series or parallel, the desired coolant may be used only with the one reservoir R.

Here, the first coolant valve 34 includes the first coolant port 34*a* toward a front end of the radiator, the second coolant port 34*b* toward a rear end of the radiator, and the third coolant port 34*c* toward the first heat exchanger 21*a*, and the second coolant valve 45 includes the fourth coolant port 45*a* toward the battery 42, the fifth coolant port 45*b* toward the second heat exchanger 21*b*, the sixth coolant port 45*c* toward the electronic part 32, and a seventh coolant port 45*d* toward the rear end of the radiator.

Furthermore, the first flow control valve 16 includes the first port 16*a* toward the outdoor condenser 14, the second port 16*b* toward the compressor 11, and the third port 16*c* toward the evaporator 15, and the third port 16*c* includes the first expander 16*d* so that the refrigerant selectively expands. The second flow control valve 22 may include the fourth port 22*a* toward the front end of the first heat exchanger 21*a*, the fifth port 22*b* toward the rear end of the outdoor condenser 14, and the sixth port 22*c* toward the second heat exchanger 21*b*, and the sixth port 22*c* may include the second expander 22*d* so that the refrigerant selectively expands.

According to embodiments of the present disclosure, as the first coolant valve 34, the second coolant valve 45, the first flow control valve 16, and the second flow control valve 22 are controlled, the various thermal management modes such as cooling of the electronic part 32 by external air, cooling of the battery 42, or indoor heating or cooling can be realized.

Furthermore, as the second radiator 43 is provided to cool the first radiator 33 and the battery 42 to cool the electronic part 32, the cooling performance of each of the electronic part 32 and the battery 42 is secured.

In addition, systems and methods according to embodiments of the present disclosure can efficiently realize various thermal management modes including heating, cooling, dehumidifying, and cooling of parts such that the first refrigerant line 10 including the outdoor condenser 14 and the second refrigerant line 20 including the heat exchanger 21 branch from each other to allow the outdoor condenser 14 and the heat exchanger 21 to be arranged in parallel to each other, so that a flow and an expansion status of refrigerant of the first flow control valve 16 and the second flow control valve 22 are adjusted.

The integrated thermal management system for a mobility, the integrated thermal management system including the above-described structure, can secure the efficiency of various thermal management modes including heating, cooling, dehumidifying, and cooling of parts, and can be reduced in manufacturing cost and package with the reduced valves and pipes for realizing the thermal management modes.

Embodiments disclosed herein can be implemented or performed by a computing device having at least one processor, at least one memory and at least one communication interface. The elements of a method, process, or algorithm described in connection with embodiments disclosed herein can be embodied directly in hardware, in a software module executed by at least one processor, or in a combination of the two. Computer-executable instructions for implementing a method, process, or algorithm described in connection with embodiments disclosed herein can be stored in a non-transitory computer readable storage medium.

Although embodiments of the present disclosure have been disclosed in detail only with respect to the above specific embodiments, those skilled in the art will appreciate that various modifications, additions, and substitutions are possible, without departing from the spirit and scope of the present disclosure, and it is appropriate that the various modifications, additions, and substitutions belong to the accompanying claims.

What is claimed is:

1. An integrated thermal management system for a mobility, the integrated thermal management system comprising:

a first refrigerant line through which a refrigerant is circulated, comprising a compressor, an indoor condenser, an expansion valve, an outdoor condenser, and an evaporator, and further comprising a first flow control valve arranged between the outdoor condenser and the evaporator and configured to control a distribution direction of the refrigerant and selectively expand the refrigerant; and a second refrigerant line comprising a heat exchanger provided at a front end of the compressor and configured to perform heat exchange with another cooling medium, and two branching line portions branching from both of a front end and a rear end of the outdoor condenser, and merging together at a merging point and then being connected to a front end of the heat exchanger, the second refrigerant line further comprising a second flow control valve arranged on the merging point and configured to control the distribution direction of the refrigerant and selectively expand the refrigerant, wherein on the first refrigerant line, the expansion valve is arranged in rear of a front branching point of the outdoor condenser in the second refrigerant line.

2. The integrated thermal management system of claim 1, further comprising:

a controller configured to control the compressor, the expansion valve, the first flow control valve, and the second flow control valve in response to a thermal management mode, wherein the first flow control valve comprises a first port toward the outdoor condenser, a second port toward the compressor, and a third port toward the evaporator, wherein the third port comprises a first expander to selectively expand the refrigerant, and wherein the second flow control valve comprises a fourth port toward a front end of the outdoor condenser, a fifth port toward a rear end of the outdoor condenser, and a sixth port toward the heat exchanger, wherein the sixth port comprises a second expander to selectively expand the refrigerant.

3. The integrated thermal management system of claim 2, wherein when cooling a cooling medium through the heat exchanger, the controller is configured to control the expansion valve to be opened, and in the first flow control valve, the controller is configured to control the second port to be closed and the first expander to perform closing operation, and in the second flow control valve, the controller is configured to control the fifth port and the sixth port to be opened and the second expander to perform an expanding operation.

4. The integrated thermal management system of claim 2, wherein when cooling an indoor space, the controller is configured to control the expansion valve to be opened, and in the first flow control valve, the controller is configured to control the first port and the third port to be opened and the first expander to perform an expanding operation, and in the second flow control valve, the controller is configured to control the fourth port to be closed and the second expander to perform a closing operation.

5. The integrated thermal management system of claim 2, wherein when heating an indoor space, the controller is configured to control the expansion valve to perform an expanding operation, in the first flow control valve, the controller is configured to control the first port and the second port to be opened and the first expander to perform closing operation, and in the second flow control valve, the controller is configured to control the fourth port and the sixth port to be opened and the second expander to perform an expanding operation.

6. The integrated thermal management system of claim 2, wherein when heating an indoor space, the controller is configured to control the expansion valve to perform an expanding operation, in the first flow control valve, the controller is configured to control the first port and the second port to be opened and the first expander to perform closing operation, and in the second flow control valve, the controller is configured to control the fourth port to be closed and the second expander to perform closing operation.

7. The integrated thermal management system of claim 2, wherein when heating an indoor space, the controller is configured to control the expansion valve to perform closing operation, in the second flow control valve, the controller is configured to control the fourth port and the sixth port to be opened and the second expander to perform an expanding operation.

8. The integrated thermal management system of claim 2, wherein when heating and dehumidifying an indoor space, the controller is configured to control the expansion valve to perform an expanding operation, in the first flow control valve, the controller is configured to control the first port and the third port to be opened and the first expander to perform an expanding operation, in the second flow control valve, the controller is configured to control the fourth port to be closed and the second expander to perform closing operation.

9. An integrated thermal management system for a mobility, the integrated thermal management system comprising:

a first refrigerant line through which a refrigerant is circulated, comprising a compressor, an indoor condenser, an expansion valve, an outdoor condenser, and an evaporator, and further comprising a first flow control valve arranged between the outdoor condenser and the evaporator and configured to control a distribution direction of the refrigerant and selectively expand the refrigerant; and a second refrigerant line comprising a heat exchanger provided at a front end of the compressor and configured to perform heat exchange with another cooling medium, and two branching line portions branching from both of a front end and a rear end of the outdoor condenser, and merging together at a merging point and then being connected to a front end of the heat exchanger, the second refrigerant line further comprising a second flow control valve arranged on the merging point and configured to control the distribution direction of the refrigerant and selectively expand the refrigerant, wherein the first flow control valve comprises a first port toward the outdoor condenser, a second port toward the compressor, and a third port toward the evaporator, wherein the third port comprises a first expander to selectively expand the refrigerant.

10. An integrated thermal management system for a mobility, the integrated thermal management system comprising:

a first refrigerant line through which a refrigerant is circulated, comprising a compressor, an indoor condenser, an expansion valve, an outdoor condenser, and an evaporator, and further comprising a first flow control valve arranged between the outdoor condenser and the evaporator and configured to control a distribution direction of the refrigerant and selectively expand the refrigerant; and a second refrigerant line comprising a heat exchanger provided at a front end of the compressor and configured to perform heat exchange with another cooling medium, and two branching line portions branching from both of a front end and a rear end of the outdoor condenser, and merging together at a merging point and then being connected to a front end of the heat exchanger, the second refrigerant line further comprising a second flow control valve arranged on the merging point and configured to control the distribution direction of the refrigerant and selectively expand the refrigerant, wherein the second flow control valve comprises a fourth port toward a front end of the outdoor condenser, a fifth port toward a rear end of the outdoor condenser, and a sixth port toward the heat exchanger, wherein the sixth port comprises a second expander to selectively expand the refrigerant.

* * * * *